US005411217A

United States Patent [19]

Ono

[11] Patent Number: 5,411,217

[45] Date of Patent: May 2, 1995

[54] COMPRESSIBLE BOBBIN FOR YARN TREATMENT

[75] Inventor: Nobutaka Ono, Ashiya, Japan

[73] Assignee: Osaka Bobbin Co., Ltd., Osaka, Japan

[21] Appl. No.: 114,742

[22] Filed: Aug. 31, 1993

[51] Int. Cl.[6] ..... B65H 75/20

[52] U.S. Cl. ..... 242/118.11; 242/604

[58] Field of Search ..... 242/118.1, 118.11, 604

[56] References Cited

U.S. PATENT DOCUMENTS

| | | | |
|---|---|---|---|
| 4,270,710 | 6/1981 | Ono | 242/118.11 |
| 4,941,621 | 7/1990 | Pasini | 242/118.1 |
| 4,986,488 | 1/1991 | Windhösel | 242/118.1 |
| 5,152,475 | 10/1992 | Pasini | 242/118.11 X |
| 5,351,351 | 10/1994 | Ono | 242/118.11 X |

*Primary Examiner*—Daniel P. Stodola
*Assistant Examiner*—Michael R. Mansen
*Attorney, Agent, or Firm*—Flynn, Thiel, Boutell & Tanis

[57] ABSTRACT

A compressible bobbin for yarn treatment having a cylindrical framework made of a synthetic resin. The bobbin includes upper and lower end rings, circumferentially equidistantly disposed vertical frames and annular horizontal frames disposed equidistantly between the end rings. Both sides of the horizontal frames and one side of the end rings are provided with vertically upstanding piece members for regulating the degree of compression of the bobbin and acting as a stopper when compressed. The vertically upstanding piece members have each a height of one half of the interval between adjacent horizontal frames and are alternately arranged every two horizontal frames to form multiple columns. When compressed, the vertically upstanding piece members of each column abut to each intervening horizontal frame and on both sides thereof in an opposing manner. The vertically upstanding piece members located at least between the lower end ring and the lowermost horizontal frame further may be provided with auxiliary ribs that interconnect vertically, on the inner cylindrical framework, the vertically upstanding piece members and the lower end ring or lowermost horizontal frame, and when compressed, are adapted to be pliably shifted in parallel with the ring and the horizontal frame. The bobbin can be compressed uniformly and prevent yarn biting therein upon compression when used for yarn treatment, thus enabling a smooth, uniform yarn treatment.

7 Claims, 3 Drawing Sheets

COMPRESSIBLE BOBBIN FOR YARN TREATMENT

BACKGROUND OF THE INVENTION

1. Field of the Invention

This invention relates to a compressible bobbin for yarn treatment which, in performing yarn treatment such as dyeing, enables the avoidance of yarn biting in the bobbin and to make the compression degree thereof uniform, thereby attaining a smooth and even treatment.

2. Statement of Related Art

In general, cheese dyeing has been carried out by winding up yarns on tapered or cylindrical bobbins to make yarn cheeses and mounting the cheeses onto each spindle to stack them one upon another while interposing a spacer between cheeses.

However, the occurrence of variation in density of the yarns was unavoidable owing to the dispersion in tension applied when yarns are wound up, or other causes. The variation in density of yarns was seen not only among cheeses, but also in each individual cheese, which was a major cause of uneven dyeing.

In order to eliminate uneven dyeing and to achieve uniform dyeing, attempts have been made to compress the cheeses after winding-up in the axial direction thereby making the yarn density uniform, and accordingly, many bobbins and methods have been proposed. Such examples include a compressible bobbin that has a number of passage holes for a treating liquid round its outer periphery and is compressible in the axial direction; an improved compressible bobbin over the aforementioned bobbin that is constructed to have a greater contraction ability in its intermediate portion as compared with both end portions in view of the fact that with a compressible bobbin contractile evenly in every portion, both end portions thereof collapse earlier than the intermediate portion; in case where bobbins are compressed in a multi-tier stacked state, a method for regulating the compression degree of the stacked bobbins to a definite magnitude by interposing incompressible bobbins between compressible bobbins belonging to the intermediate tiers thereby attaining a uniform compression in view of the fact that otherwise, the compressive degree of the intermediate-tier bobbins is lowered.

However, problems with the compressible bobbins stated above are that when wound-up bobbins are compressed, there is no stopper means for regulating the compression degree of the bobbin and consequently, unevenness in compression is liable to occur; and the inner yarns are, when compressed, bitten between annular horizontal frames of the aforesaid bobbins and are subjected to yarn treatment in the yarn biting state, which have impeded a smooth, uniform treatment of yarns.

SUMMARY OF THE INVENTION

This invention is therefore designed for a compressible bobbin for yarn treatment which is provided with means for eliminating uneven compression and means for impeding the biting of yarns upon compression.

An essential object of this invention is to provide a compressible bobbin capable of not only making the compression degree uniform to ensure a uniform space for a treating liquid, but also impeding yarn biting in the bobbin thereby to avoid yarn treatment in the yarn biting state and to enable an even, smooth yarn treatment.

In accordance with this invention, there is provided a compressible bobbin for yarn treatment made of a synthetic resin, which comprises a pair of upper and lower end rings positioned horizontally in opposed relation to each other at a required distance; a plurality of vertical frames disposed axially in parallel with one another and circumferentially equidistantly to interconnect the end rings and adapted to be deformed in a zigzag form when axially compressed; and a plurality of annular horizontal frames disposed equidistantly in parallel with and between the end rings in a manner intersecting the vertical frames, thus forming a cylindrical framework and is characterized in that the framework further comprises multiple columns of axially aligned vertically upstanding piece members for regulating the compression degree of the bobbin to function as a stopper when axially compressed. The vertically upstanding piece members each have a height of half of the interval between any two adjacent horizontal frames or either endmost horizontal frame and either end ring adjacently disposed thereto and are disposed vertically upstanding on each annular horizontal frame and either end ring on and beneath them in the whole length of the bobbin extending from the upper to the lower end rings so that the vertically upstanding piece members may be arranged in turn alternately between any two adjacent horizontal frames between any two adjacent vertical frames in a staggered manner. The vertical piece members of each column, when axially compressed, are adapted to abut to each intervening horizontal frame, to which its adjacent column of vertically upstanding piece members are attached, in opposing manner, thus forming each apparent linear vertical member.

The vertically upstanding piece members each assume a truncated quadrilateral pyramidal shape tapering down toward their upper or lower top ends and are formed so that a radially inner face of each member is flush with the inner peripheral face of the cylindrical framework and a radially outer face of each member is located radially inwardly of the outer peripheral face of the cylindrical framework, any two laterally adjacent vertically upstanding piece members facing at mutually opposite angles relative to the radial direction of the bobbin.

It is preferred that at least the vertical piece members located between the lower end ring and the lowermost annular horizontal frame adjacent to it be provided with auxiliary ribs interconnecting vertically the radially inner top end of each vertical piece member and the radially inner face of the lower end ring or lowermost horizontal frame. By the additional provision of the auxiliary ribs, it is possible to ensure the uniformity in compression degree of the bobbin upon axial compression and to avoid securely the yarn biting upon compression, which is likely to occur most often between the lower end ring and the lowermost horizontal frame if any yarn biting still occurs, thus enhancing the uniformity and smoothness in yarn treatment.

The auxiliary ribs may be provided further at the vertical members located between the upper end ring and the uppermost annular horizontal frame adjacent to it or the vertically upstanding piece members located between any adjacent horizontal frames in the intermediate zone of the bobbin.

When the compressible bobbin thus constructed is wound up thereon with yarns and axially compressed, the bobbin assumes such a state that the vertical frames are bent in a zigzag manner, mutually adjacent annular horizontal frames tend to shift in opposite directions, and any two columns of vertically upstanding piece members, arranged alternately between two horizontal frames between any adjacent vertical frames abut to each intervening horizontal frame at both sides thereof in opposing manner, thereby forming each two vertical linear members.

In case where the bobbin is further provided with the auxiliary ribs, the auxiliary ribs laterally adjacently disposed between adjacent vertical frames are slanted to assume a parallelogramic shape together with their vertically upstanding piece members and ultimately, collapsed and shifted in parallel with the lower end ring and lowermost horizontal frame, without breaking.

As a result of the compression, the multiple columns of vertically upstanding piece members serve as a stopper, which regulates the compression degree of the bobbin and affords a uniform compression of the bobbin. The yarns wound thereon are also compressed in a uniform compressed state.

Furthermore, the vertically upstanding piece members alone or in combination with the auxiliary ribs prevent the yarns from intruding into the inside of the bobbin and consequently, no yarn biting occurs.

Thus, a smooth, uniform yarn treatment is enabled without causing yarn biting in the bobbin.

The invention will be hereinafter described in more detail with reference to the accompanying drawings.

BRIEF DESCRIPTION OF THE DRAWINGS

Throughout the drawings and the description, like elements or components are designated by like reference numerals.

DESCRIPTION OF PREFERRED EMBODIMENTS

Figure 1:
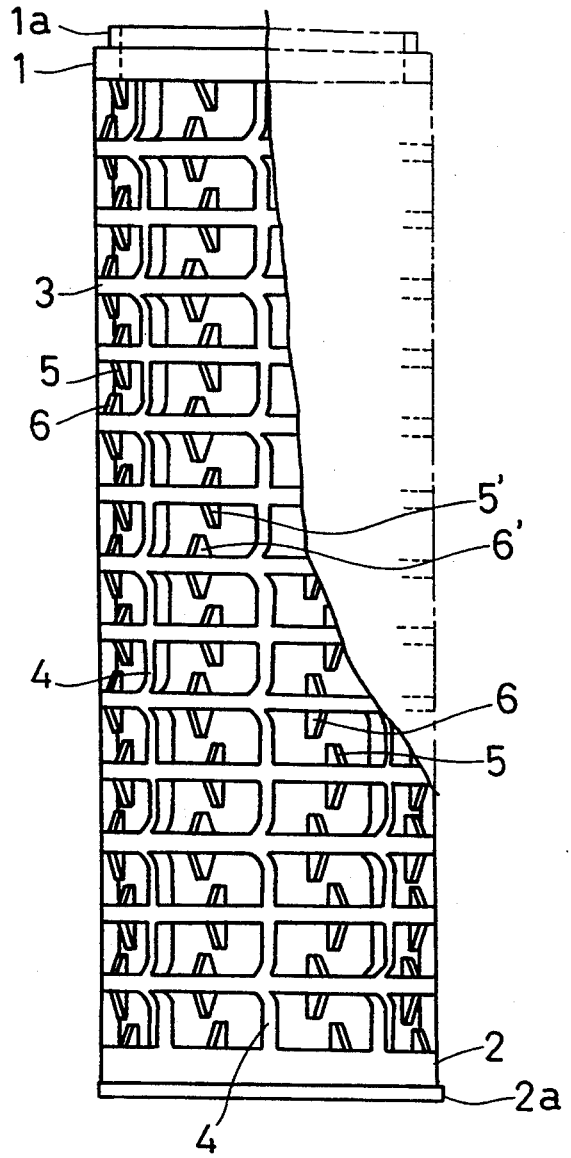
FIG. 1 is a schematic front elevational view of one example of a press bobbin embodying the invention.
Figure 3:
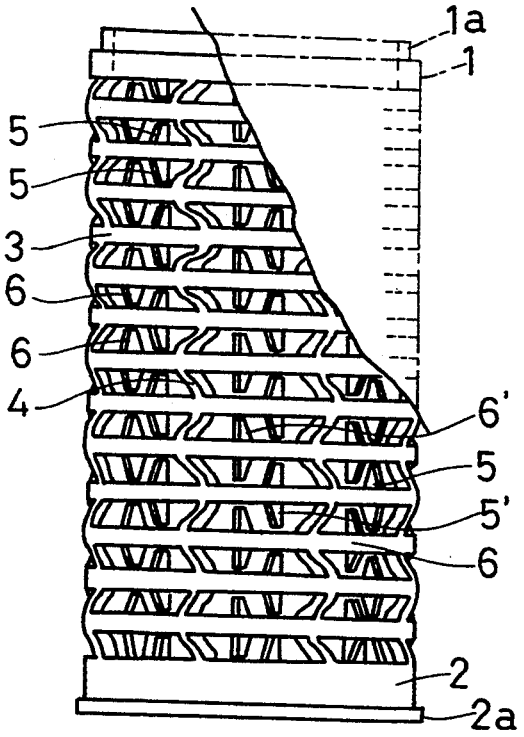
FIG. 3 is a schematic view showing a compressed state of the bobbin in FIG. 1.
Figure 2:
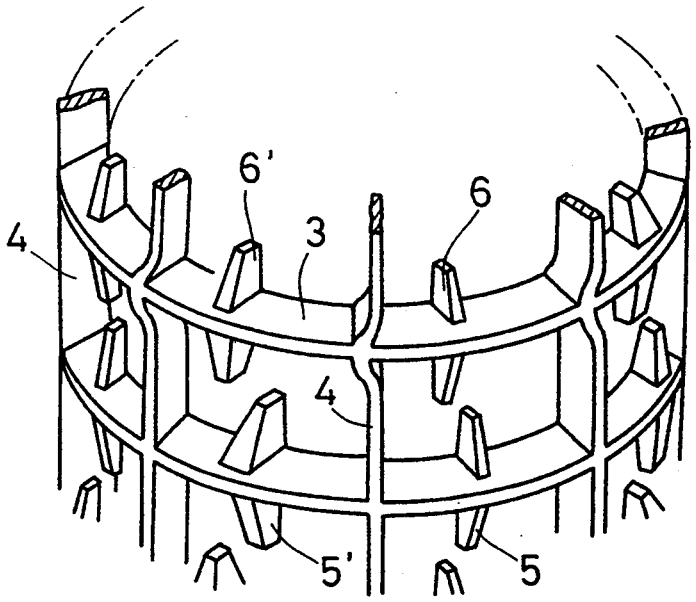
FIG. 2 is a fragmentary enlarged perspective view of FIG. 1.

In FIGS. 1 to 3, the reference numerals 1,2 designate a pair of upper and lower end rings disposed vis-a-vis to each other at both ends of a bobbin; 4 designates a plurality of vertical or rectilinear longitudinal frames which extend, within a cylindrical face including the end rings 1,2, axially in parallel with one another to interconnect the end rings 1,2 and are disposed circumferentially equidistantly spaced from one another; 3 designates annular horizontal frames disposed equidistantly in parallel with and between the end rings 1,2 and extending orthogonally intersecting with the vertical frames 4. The end rings 1,2, vertical frames 4 and annular horizontal frames 3 thus form a lattice-like framework of the bobbin pertaining to this invention.

The bobbin is usually fabricated by integral molding of a thermoplastic resin such as polypropylene, polyethylene, etc.

The end rings 1,2 are spaced apart a required distance to face each other, thereby determining the length of the bobbin. The vertical end faces of the end rings 1,2 are flat and smooth, and are formed as upper and lower components **1*a*,2*a* having a good fitting ability so that bobbins can be stacked one upon another by fitting of the one component of one bobbin and the other component of another bobbin. Where bobbins are stacked by interposing a spacer, it is naturally possible to form the end faces of the end rings 1,2** in a different fashion.

In the example illustrated in FIGS. 1 to 3, the vertical frames 4 are curved in a V-bent form in the junctions with the endmost horizontal frames 3 adjacent to both end rings 1,2 and the horizontal frames 3 located every two horizontal frames from the endmost horizontal frames, thereby facilitating the compression of the bobbin.

The horizontal frames 3,3 are provided with vertically upstanding piece members 5,6 or 5',6' between any adjacent vertical frames 4,4. The vertically upstanding piece members 5,6 each extend on upwardly and downwardly from each horizontal frame 3 up to a midpoint of a location between the horizontal frames 3,3 and are alternately arranged every two horizontal frames 3,3 in series ( 5,6,5,6, . . . ), thus forming pairs of column of vertically upstanding piece members 5,5, . . . and 6,6, . . . between any two adjacent vertical frames 4,4 over the whole length of bobbin.

The vertically understanding piece members 5,6 are, when axially compressed, adapted to abut to each horizontal frame 3 intervening between the vertically upstanding piece members 5,5 ;6,6 at both sides thereof in an opposing manner (5,5, . . . ; 6,6, . . . ), whereby the degree of compression is regulated (FIG. 3).

Each of the vertically upstanding piece members 5,6, 5',6' is fashioned as a generally truncated quadrilateral pyramidal body tapering down to an upper or a lower top end thereof as shown in FIG. 2. The inner contour of the vertically upstanding piece members 5,6 is flush with the cylindrical inner wall defined by both end rings 1,2, the vertical frames 4 and the annular horizontal frames 3 while the radially outer contour of them is not flush with the cylindrical outer wall of the bobbin, but is located radially inwardly of it.

In FIG. 2, the vertically upstanding piece members 5,5' or 6,6' located laterally adjacent to each other among any three adjacent vertical frames 4,4,4 have radially outer faces of different surface areas, but, of course, may have the same surface area and the same shape, if only they can endure the compression force. However, the laterally adjacent vertically upstanding piece members 5,5' or 6,6' preferably face at mutually opposite angles relative to the radial direction of the bobbin. This acts effectively against the tendency of the bobbin toward distortion when a pressure is applied.

In performing yarn treatment such as dyeing by the use of the bobbin as described above, at the outset, yarns to be treated are wound up on the bobbin with a highest possible tension or a highest tension.

A pressure is exerted on the bobbin thus having winding yarn layers in the axial direction thereof to compress it. At that time, the vertical frames 4 are bent in an undulate form and the vertically upstanding piece members 5,5 ; 6, 6 oppose to one another as shown in FIG.

3, thereby shortening the length of bobbin and relaxing the tension on the winding yarn layers.

Concurrently with the tension relaxation, the yarns wound on the bobbin are loosened and will intrude into the inside of the bobbin from between the horizontal frames 3,3 if there is no preventive means of intrusion. In this invention, however, the vertically upstanding piece members 5,6 or 5', 6' are located close together, intervening between the horizontal frames 3,3 in blocking manner. Yarn biting upon tension relaxation is therefore impeded and yarn treatment can be performed smoothly and uniformly.

Another example of a press bobbin is illustrated in FIGS. 4 to 7.

Figure 4:
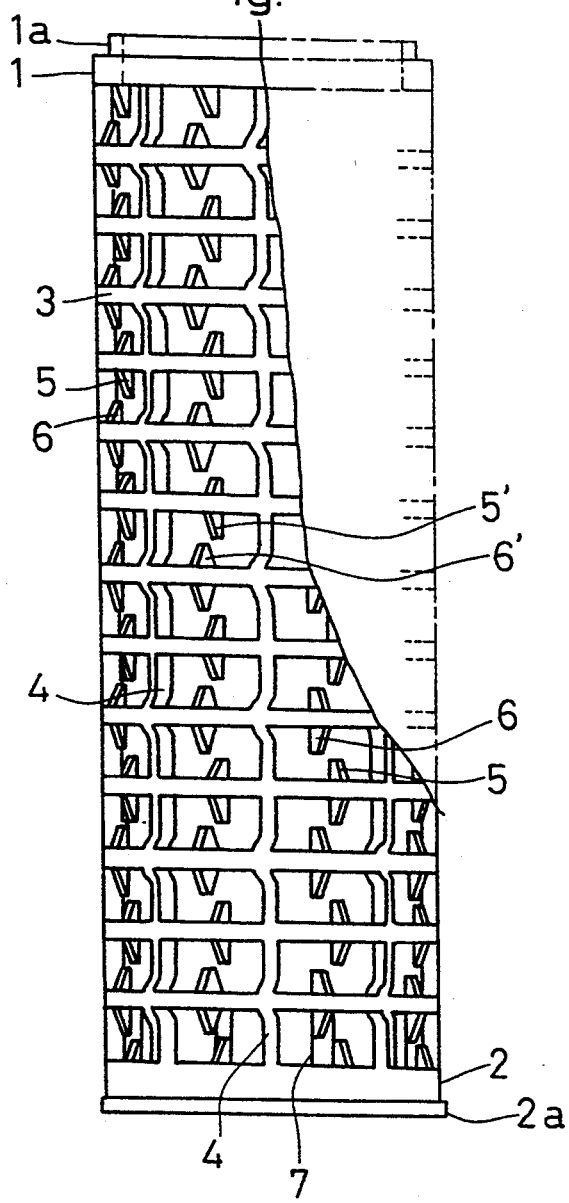
FIG. 4 is a schematic front elevational view of another example of a press bobbin embodying this invention.
Figure 5:
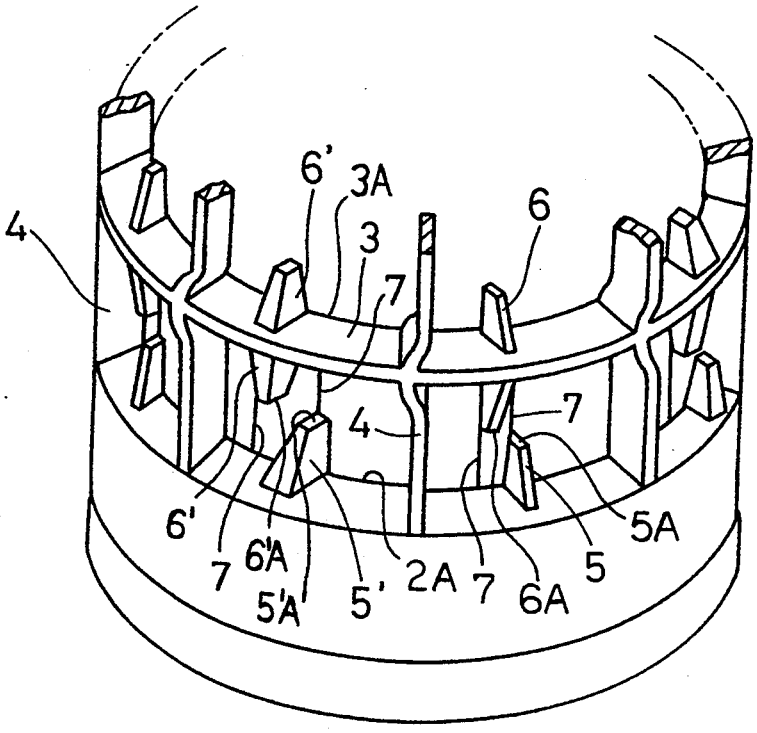
FIG. 5 is a fragmentary enlarged perspective view of FIG. 4 showing its lower portion.

In this example, the press bobbin is similarly constructed to the foregoing example except that the vertically upstanding piece members 5,6; 5',6' located between the lower end ring 2 and the lowermost annular horizontal frame 3 adjacent thereto are provided with auxiliary ribs 7 of a linear form which interconnect the inner top end 5A, 5' A or 6A, 6' A of a vertically upstanding piece member and the inner face of the lower end ring 2 or the inner face 3A lowermost horizontal frame 3, as shown in FIGS. 4 and 5. The construction and functions of the bobbin except for the auxiliary ribs 7 are the same as in the previous example, and no further description will be necessary.

The position where the auxiliary ribs 7 are provided in an area between the lower end ring 2 and the lowermost annular horizontal frame 3 in this example, but is not limited to the area and it is possible to additionally provide the auxiliary ribs between the upper end ring 1 and the uppermost annular horizontal frame 3 adjacent to it and/or between any adjacent annular horizontal frames 3,3 in the intermediate area of the bobbin.

Figure 7:
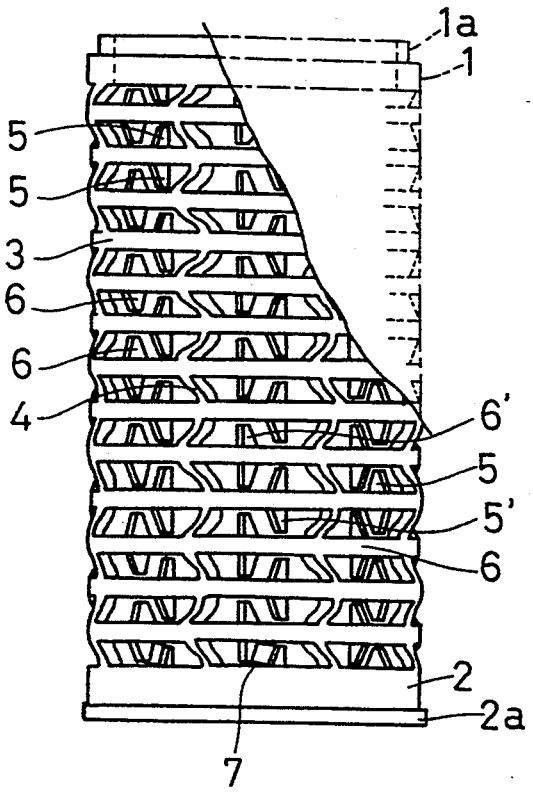
FIG. 7 is a schematic view showing a compressed state of the press bobbin in FIG. 4.
Figure 6:
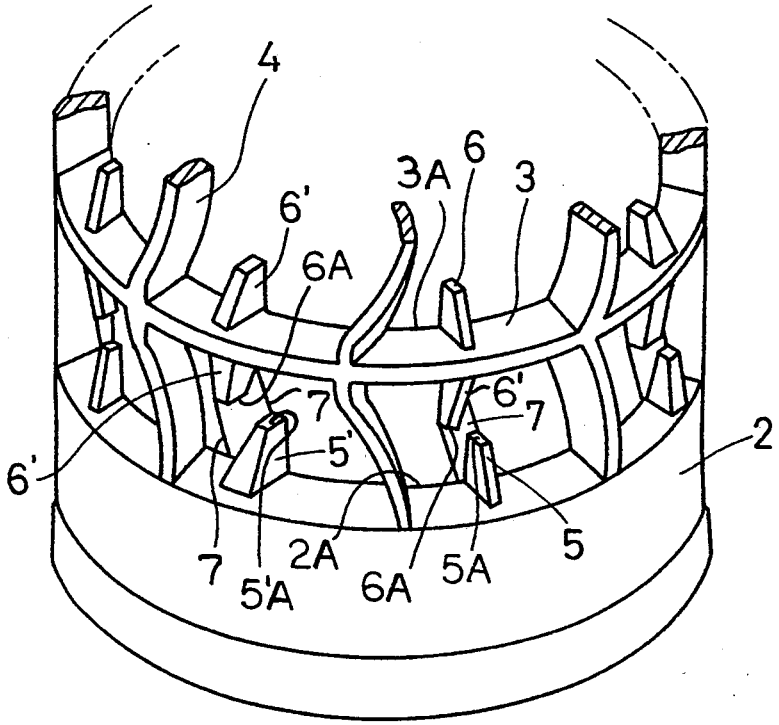
FIG. 6 is a schematic view showing a state of the lower portion of the bobbin in FIG. 5 being compressed.

When the bobbin is axially compressed, the auxiliary ribs 7 are slanted to assume a parallelogramic form, as shown in FIG. 6, between any two adjacent vertical frames 4 together with the vertically piece members 5,6;5',6' and ultimately are compressed into an inclined state shown in FIG. 7 without being broken, during the course of which the parallelogramic form is gradually shifted to a rectangular form. Being made of a synthetic resin, the auxiliary ribs 7 have an elongation of the resin itself, which enables the pliable compression of the auxiliary ribs without breakage.

In performing a yarn treatment such as dyeing by the use of the bobbin provided with the auxiliary ribs, yarns are wound up on it with a highest possible tension and the resulting bobbin having thereon yarn layers is compressed in the axial direction, as is the case with the previous example. At that time, the auxiliary ribs 7 are slanted or inclined, forming two sides of a parallelogram (FIG. 6) ultimately to be in substantially parallel alignment with the annular horizontal frame 3 and the lower end ring 2. On the other hand, the yarn layers on the bobbin are loosened and act to intrude into the bobbin from between laterally adjacently disposed vertical piece members 5 and 6 (5' and 6').

The intrusion of yarn layers between adjacent vertically upstanding piece members 5, 6, when the bobbin is axially compressed, can be blocked mostly by the vertically upstanding piece members 5,6,5', 6' abutting to each intervening horizontal frame 3. However, as the case may be, yarn layers intrude in the bobbin from between laterally adjacent vertically upstanding piece members 5,6 and after the compression, remain bitten in the bobbin.

The tendency of intrusion of yarn layers can be seen most often between the lower end ring 2 and the lowermost horizontal frame 3, occasionally between the upper end ring 1 and adjoining uppermost horizontal frame 3, and rarely between adjacent horizontal frames 3 in the intermediate part of the bobbin. This is because the yarn layers located at the lower part between the lower end ring and lowermost horizontal frame have a greater freedom in mobility when loosened and are susceptible to a shock when the bobbin is mounted on a spindle and accordingly, prone to be displaced downwardly.

The auxiliary ribs 7 located between the lower end ring 2 and the lowermost horizontal frame 3 never fail to prevent the intrusion of yarn layers since they always span the vertical space between the vertically upstanding piece members 5,5';6,6' and the lower end ring 2.

Thus, in this example, yarn intrusion or biting into the bobbin upon compression can be prevented securely, and consequently, yarn treatment such as dyeing can be performed smoothly and uniformly.

As described above, the press bobbin of this invention is provided with the vertically upstanding piece members for uniformly regulating the compression degree of bobbin and serving as a stopper when axially compressed, alone or in combination with the pliable auxiliary ribs for blocking always the lateral interstices between vertically upstanding piece members. As a consequence, when the bobbin is used for yarn treatment, the compressed bobbin has open spaces over the whole length of bobbin, through which a treating liquid flows uniformly, and its vertically upstanding piece members alone or together with the auxiliary ribs effectively eliminate such a possibility that yarns intrude in the bobbin. As a result, yarn biting is prevented completely and a uniform, smooth yarn treatment is ensured. Moreover, yarns of good quality are available.

By varying and altering the shapes of the vertically upstanding piece members and auxiliary ribs, it is possible to enhance the compression efficiency and the effect of impeding yarn biting.

What is claimed is:

1. A compressible bobbin for yarn treatment made of a synthetic resin which comprises a pair of upper and lower end rings positioned in opposed relation to each other and spaced a required distance apart from one another; a plurality of rectilinear longitudinal frames disposed axially in parallel relation with one another, oriented over a majority of the length thereof in planes containing a central axis of the bobbin, and are equidistantly spaced circumferentially of the bobbin to interconnect the end rings and become deformed in a zigzag form when axially compressed; and a plurality of annular frames disposed equidistantly between said end rings in parallel relation to the end rings in a manner intersecting the rectilinear longitudinal frames, thus forming a cylindrical framework;

the cylindrical framework further comprising multiple columns of upstanding piece members for regulating a degree of compression of the bobbin and functioning as a stopper when the cylindrical framework is axially compressed, the upstanding piece members having a height equal to one half of the interval between any two adjacent annular frames or between either endmost annular frame and either adjacently disposed end ring, said upstanding piece members being disposed upstandingly on both sides of each annular frame and on one side of each end. ring over the whole length of the bobbin spanning the distance between the end rings, the upstanding piece members being arranged between any two adjacent annular frames and between any two adjacent rectilinear longitudinal frames and in an alternatingly staggered manner and, when the bobbin is in either the compressed state or the noncompressed state, are circumferentially spaced apart and free of engagement with one another; and the upstanding piece members of each column, when axially compressed, abutting each intervening horizontal frame on both sides thereof in an opposing manner.

2. The compressible bobbin for yarn treatment as set forth in claim 1, wherein each of said upstanding piece members is in a shape of a truncated quadrilateral pyramid tapering from said end rings and said annular frames to a distal end thereof, and is formed so that a radially inner contour thereof is flush with an inner peripheral face of the cylindrical framework and a radially outer contour thereof is located radially inwardly of an outer peripheral face of the cylindrical framework, any two laterally adjacent upstanding piece members facing at mutually opposite angles relative to the radial direction of the bobbin.

3. The compressible press bobbin for yarn treatment as set forth in claim 2, wherein said any two laterally adjacent upstanding piece members have trapezoidal faces of mutually different surface areas on the radially outer contour.

4. The compressible bobbin for yarn treatment as set forth in claim 2, wherein the Upstanding piece members located at least between one end ring and a next adjacent annular frame are further provided with auxiliary ribs interconnecting the upstanding piece members to the said next adjacent annular frame or said one end ring, the auxiliary ribs each extending longitudinally of the bobbin from a radially inner distal end of the upstanding piece member to a radially inner face of the said one end ring or the next adjacent annular frame and, when axially compressed, being pliably shifted in parallel with the said one end ring and said next adjacent horizontal frame.

5. The compressible bobbin for yarn treatment as set forth in claim 1, wherein the upstanding piece members upstandingly disposed on both sides of each annular frame are aligned with one another, the upstanding piece members on every other one of the annular frames being aligned with one another and in a first column whereas the upstanding piece members on the annular frames oriented in between said every other one of said annular frames being aligned with one another in a second column separate from said first column.

6. The compressible bobbin for yarn treatment as set forth in claim 5, wherein said upstanding piece members on at least one end ring are oriented in said first column.

7. The compressible bobbin for yarn treatment as set forth in claim 5, wherein said upstanding piece members on both end rings are oriented in the same column.

* * * * *